US007900867B2

(12) United States Patent
Li

(10) Patent No.: US 7,900,867 B2
(45) Date of Patent: Mar. 8, 2011

(54) PERSONAL PROPULSION DEVICE

(76) Inventor: Raymond Li, St. John's (CA)

( * ) Notice: Subject to any disclaimer, the term of this patent is extended or adjusted under 35 U.S.C. 154(b) by 0 days.

(21) Appl. No.: 12/767,216

(22) Filed: Apr. 26, 2010

(65) Prior Publication Data

US 2010/0200702 A1 Aug. 12, 2010

Related U.S. Application Data

(60) Division of application No. 11/789,552, filed on Apr. 25, 2007, now Pat. No. 7,735,772, which is a continuation of application No. 11/088,330, filed on Mar. 23, 2005, now Pat. No. 7,258,301.

(60) Provisional application No. 60/556,396, filed on Mar. 26, 2004, provisional application No. 60/581,438, filed on Jun. 22, 2004.

(51) Int. Cl.
*B64C 29/00* (2006.01)
*B64C 39/02* (2006.01)

(52) U.S. Cl. ..... 244/4 A; 114/315; 440/38

(58) Field of Classification Search ..... 244/4 A; 114/315; 440/23, 38
See application file for complete search history.

(56) References Cited

U.S. PATENT DOCUMENTS

| | | | |
|---|---|---|---|
| 1,833,354 | A | 12/1931 | Bauer |
| 2,461,347 | A | 2/1949 | Pentecost |
| 2,509,603 | A | 5/1950 | Marin |
| 2,920,841 | A | 1/1960 | Junker |
| 3,021,095 | A | 2/1962 | Moore |
| 3,023,980 | A | 3/1962 | Martin et al. |
| 3,149,798 | A | 9/1964 | Moore |
| 3,176,984 | A | 4/1965 | Sullivan |
| 3,243,144 | A | 3/1966 | Hulbert et al. |
| 3,245,637 | A | 4/1966 | Eickmann |
| 3,277,858 | A | 10/1966 | Athey |
| 3,381,917 | A | 5/1968 | Moore et al. |
| 3,443,775 | A | 5/1969 | William |
| 3,474,987 | A | 10/1969 | Meditz |
| 3,503,574 | A | 3/1970 | Eickmann |
| 3,556,438 | A | 1/1971 | Meditz |
| 3,570,785 | A | 3/1971 | Croft et al. |
| 3,586,263 | A | 6/1971 | Payne |
| 3,614,024 | A | 10/1971 | Millman |
| 3,700,172 | A | 10/1972 | Gallegos |
| 4,040,577 | A | 8/1977 | Moore |
| 4,348,976 | A | 9/1982 | Gilbert |
| 4,417,706 | A | 11/1983 | Miller |
| 4,541,357 | A | 9/1985 | Stanton |
| 4,738,212 | A | 4/1988 | Schweitzer |
| 5,679,035 | A | 10/1997 | Jordan |
| 5,779,188 | A | 7/1998 | Frick |
| 6,488,232 | B2 | 12/2002 | Moshier |

*Primary Examiner* — Tien Dinh
*Assistant Examiner* — Joseph W Sanderson
(74) *Attorney, Agent, or Firm* — Christopher & Weisberg, P.A.

(57) ABSTRACT

The present invention provides a personal propulsion device including a body unit having a center of gravity, where the body unit includes a thrust assembly providing a main conduit in fluid communication with at least two thrust nozzles, with the thrust nozzles being located above the center of gravity of the body unit. The thrust nozzles are independently pivotable about a transverse axis located above the center of gravity, and may be independently controlled by a single common linkage. The present invention may further include a base unit having an engine and a pump, which provides pressurized fluid to the body unit through a delivery conduit in fluid communication with both the base unit and the thrust assembly.

15 Claims, 6 Drawing Sheets

PERSONAL PROPULSION DEVICE

CROSS-REFERENCE TO RELATED APPLICATION

This application is a Divisional of U.S. Utility patent application Ser. No. 11/789,552, filed Apr. 25, 2007, by Raymond Li, entitled PERSONAL PROPULSION DEVICE, now allowed, which application is a Continuation of U.S. Utility patent application Ser. No. 11/088,330, filed Mar. 23, 2005, by Raymond Li, entitled PERSONAL PROPULSION DEVICE, now U.S. Pat. No. 7,258,301, issued Aug. 21, 2007, which application is related to and claims priority to U.S. Provisional Patent Application Ser. No. 60/556,396, filed Mar. 26, 2004, entitled PERSONAL PROPULSION DEVICE, which application is related to U.S. Provisional Patent Application Ser. No. 60/581,438, filed Jun. 22, 2004, entitled PERSONAL PROPULSION DEVICE, the entirety of which is incorporated herein by reference.

STATEMENT REGARDING FEDERALLY SPONSORED RESEARCH OR DEVELOPMENT n/a

FIELD OF THE INVENTION

The present invention relates to powered flight, more specifically, to a personal propulsion device.

BACKGROUND OF THE INVENTION

Personal flight has been an eternal dream and a recent reality. However, unlike birds, human beings have a low power-to-weight ratio, and personal flight has only been accomplished by developing machines using powerful engines and aerodynamic lifting surfaces, such as autogyro aircraft, fixed wing airplanes, and helicopters. Arguably, the closest experience to that of individual, unrestricted flight has been attained through the use of single passenger devices, consisting mainly of a flight pack or similar structure that fits on or around the torso of an individual.

Typically, flight packs include propulsion devices such as propellers, rotor blades, or rockets, which often require a highly flammable fuel in order to generate sufficient thrust for flight. In addition to having a reservoir of volatile fluid attached to the body of a pilot, the close proximity of the propeller, rotor blades, or rocket exhaust to the pilot further poses significant safety risks. Another drawback of such self-contained, single-passenger flight packs is that the pilot must support the entire weight of both the airframe and fuel on his back, which can be highly uncomfortable and places severe limits on operation duration and range. Moreover, the location of thrust forces and the weight distribution of the fuel and accompanying components in such designs increase instability during take-off and for the duration of the flight.

Existing single passenger devices suffer an additional major drawback, in that the fuselage, engine, electrical equipment, fuel, and flight instrumentation are all part of the aircraft. As a result of the added weight of these systems, a significant amount of engine output and fuel is required to generate sufficient thrust to achieve flight. This necessitates larger and heavier engines and, even then, the power-to-weight ratio is often quite low.

As an alternative to employing the combustion of volatile fluids to directly generate thrust, the high-pressurization of non-flammable fluids, such as water, has been proposed to create sufficient thrust in order to achieve flight. While the use of pressurized water may significantly reduce the above-mentioned safety risks, even water-propelled devices still have drawbacks in that the pressurization source must be carried into the air along with the fuselage and accompanying systems, contributing to a low power-to-weight ratio, and requiring larger engines in order to generate sufficient thrust.

It would be desirable to provide a single passenger aircraft that is safe, stable, and achieves a higher power-to-weight ratio than typical single-passenger devices. Moreover, it would be desirable to provide a single passenger aircraft that provides maneuverability, vertical takeoff and landing, as well as practical flight range and duration.

SUMMARY OF THE INVENTION

The present invention provides a personal propulsion device having a body unit, a base unit, and a delivery conduit in fluid communication with both the body unit and the base unit. The body unit may include a thrust assembly having at least two independently pivotable thrust nozzles, as well as a single linkage that accomplishes the pivoting movement. The nozzles are located above a center of gravity for the body unit, which provides inherent stability when the personal propulsion device is in use. The body unit may further include buoyant characteristics, as well as throttle controls and the like.

The base unit can include a wave-piercing hull that encloses an engine and a pump, which provides pressurized fluid to the delivery conduit. The delivery conduit subsequently delivers the pressurized fluid to the body unit, in order to provide sufficient thrust to lift the body unit and an operator into the air.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
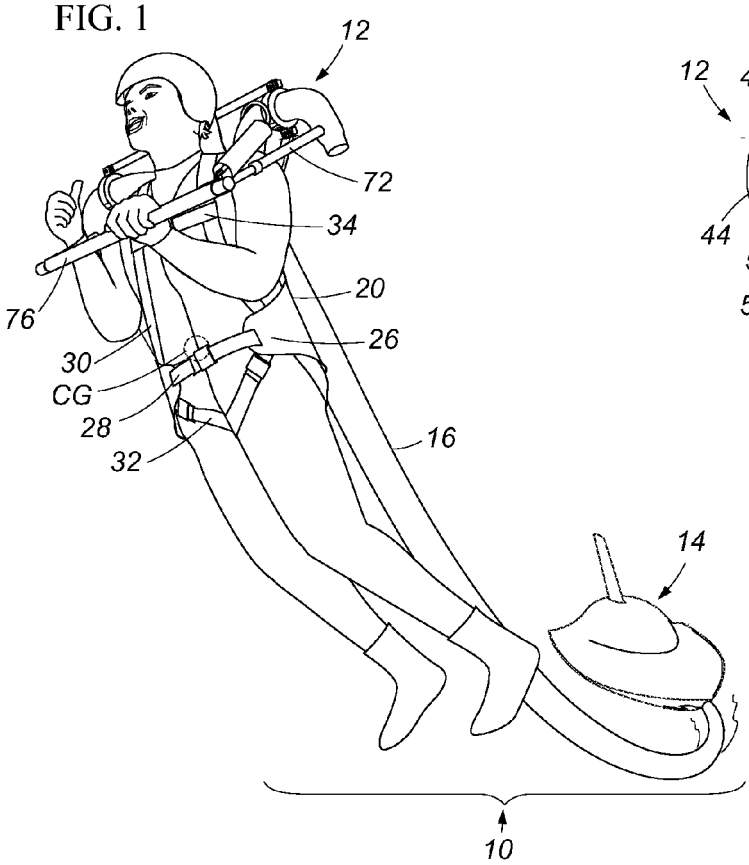
FIG. 1 illustrates a personal propulsion device in accordance with the present invention.

Now referring to FIGS. 1 through 4, an exemplary embodiment of the present invention provides a personal propulsion device 10 having a body unit 12, a base unit 14 capable of providing pressurized fluid flow, and a delivery conduit 16 in fluid communication with both the body unit 12 and the base unit 14.

The body unit 12 includes a body harness system 18 having a torso corset 20, a seat post 22 and a saddle 24. The torso corset 20 may have a modified barrel shape, contoured to provide firm support, protection and comfort for the torso, while further transmitting the lifting and gravity forces to an operator. While the torso corset 20 is preferably made of a generally rigid material such as fiberglass-reinforced plastic, the torso corset 20 may include flexible extension flaps 26 that wrap around the waist of an operator. An extension flap cushioning 27 may be attached to the extension flaps 26, thereby providing a band of foam-like material that cushions and supports the weight of the body unit 12 and the body harness system 18 on the hip bone of an operator. The body harness system 18 can further include a waist strap 28, shoulder straps 30, groin straps 32, and a chest strap 34 to hold an operator in place. Furthermore, a corset extension 36 provides protection for the rear regions of the operator's head and neck. The torso corset 20 and harness system 18 provide rigidity to the body unit 12 for improved stability, provide protection and comfort to the operator, and distribute a substantial amount of the operator's bodyweight over a wide area including the torso, groin and buttocks areas. In addition to promoting stability, the torso corset 20 and the accompanying straps and cushioning can be made from a buoyant material sufficient to keep the body unit 12 and an operator of at least 200 pounds afloat in a body of water for a prolonged period of time.

The seat post 22 and the saddle 24 of the body unit 12 support part of the weight of the operator and, in addition to the rigidity provided by the harness system 18, further reduce unnecessary movements and oscillations of the lower torso of an operator which can destabilize the body unit 12 during flight. The weight of the operator is distributed over the saddle 24, the groin straps 32, as well as over the contact surfaces with the torso corset 20 and the body harness system 18.

Figure 2:
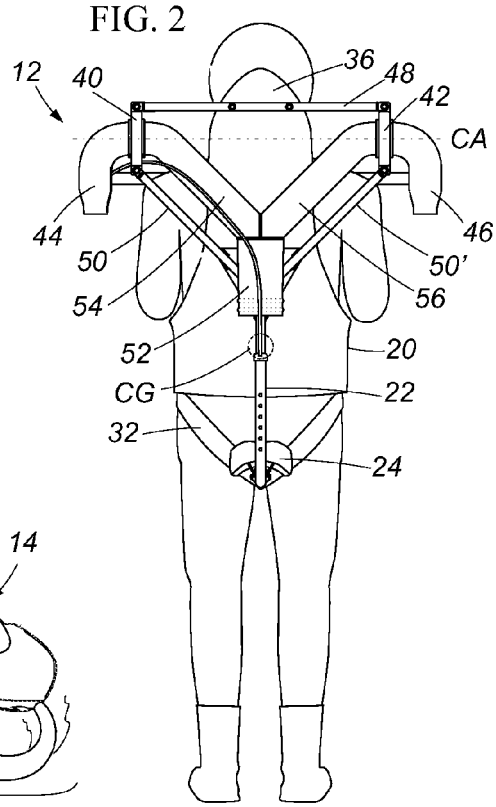
FIG. 2 is a rear view of a personal propulsion device in accordance with the present invention.
Figure 3:
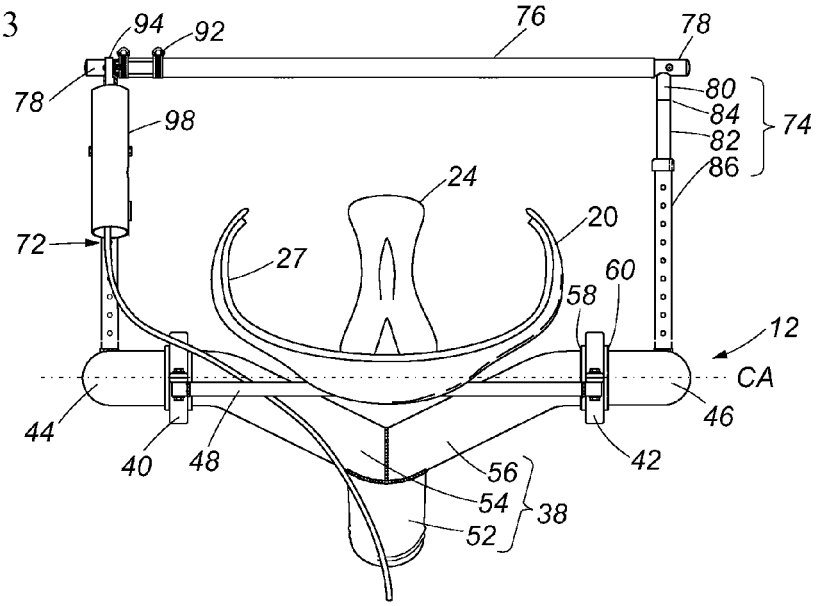
FIG. 3 is a top view of a personal propulsion device in accordance with the present invention.
Figure 4:
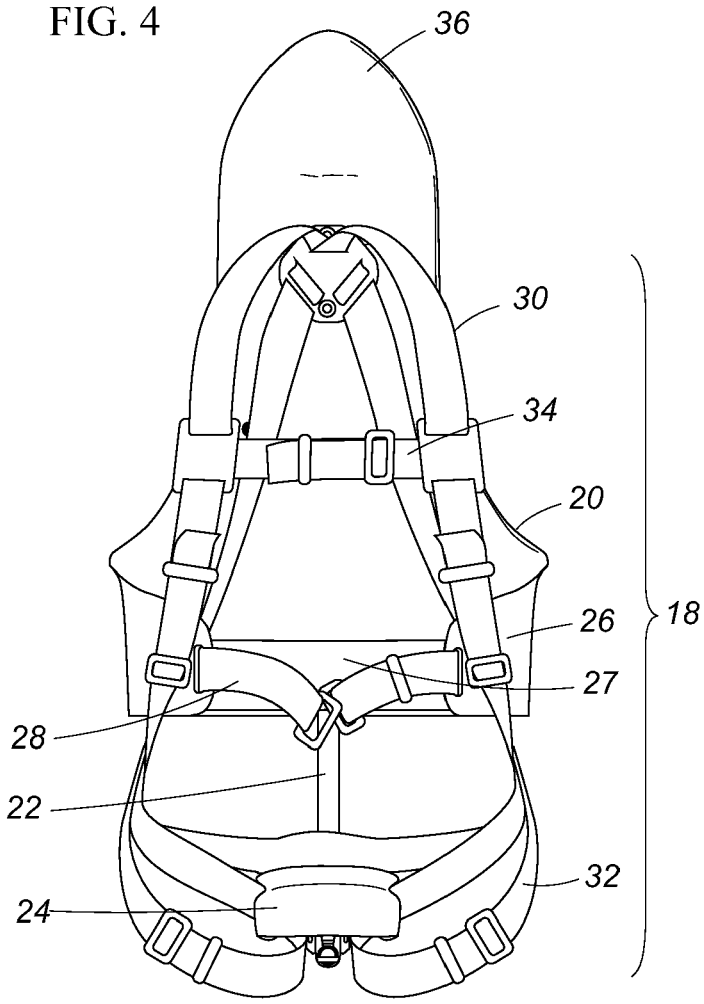
FIG. 4 is a front view of a harness system of a personal propulsion device in accordance with the present invention.

As shown in FIGS. 1-3, the body unit 12 has a thrust assembly having a supply conduit assembly 38, left swivel housing 40, right swivel housing 42, left thrust nozzle 44, and right thrust nozzle 46. Each swivel housing is affixed to or is integral with an upper support arm 48 and a pair of lower support arms 50, 50', with both the upper and lower support arms being affixed to the torso corset 20 in order to transmit lift and propulsion forces. The supply conduit assembly 38 further includes a medially located and vertically disposed main conduit 52 that rises from about mid-back level and branches into a left bifurcation conduit 54 and a right bifurcation conduit 56. Both bifurcated conduits course upward and forward to terminate in flanges 58, which are pivotally mounted inside both the left swivel housing 40 and the right swivel housing 42. The bifurcated conduits are preferably made from 3.00" outside diameter rigid tubing, while the main conduit 52 is preferably made from 4" outside diameter rigid tubing, with the upper end formed to join smoothly with the bifurcated conduits.

Figure 5:
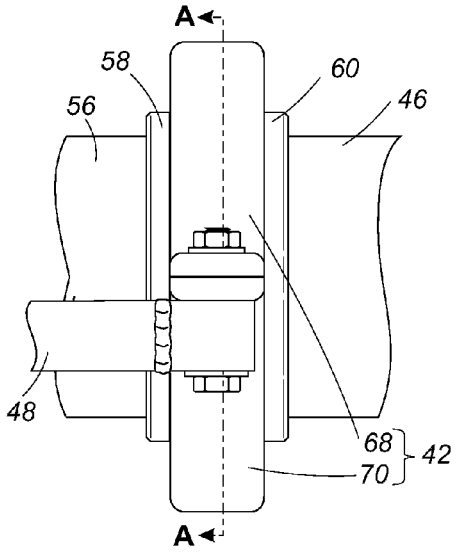
FIG. 5 is a top view of a swivel housing of a personal propulsion device in accordance with the present invention.
Figure 6:
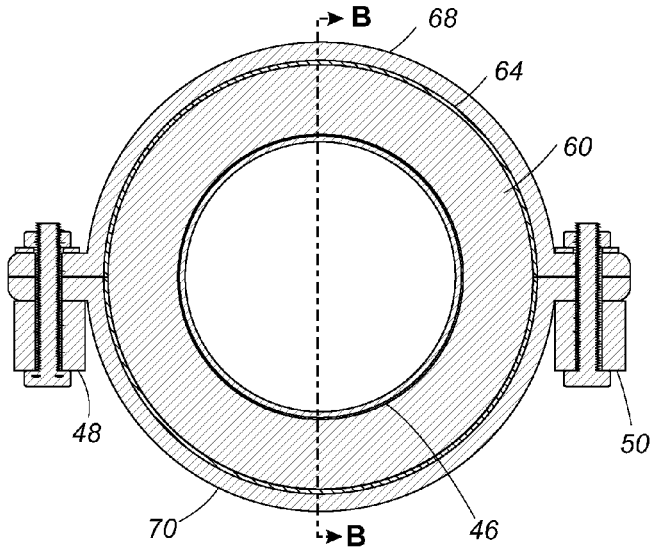
FIG. 6 is a cross sectional view of the swivel housing at line A-A of FIG. 5.
Figure 7:
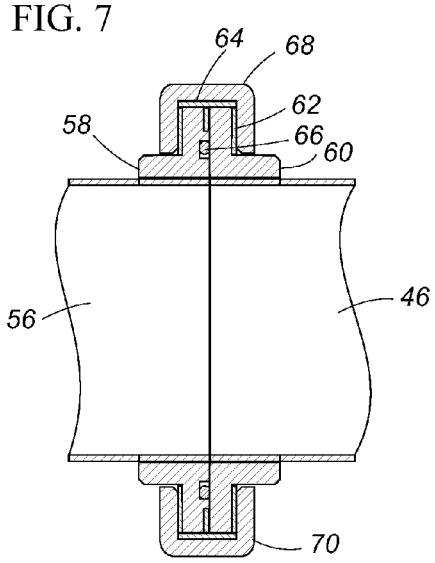
FIG. 7 is a cross sectional view of the swivel housing at line B-B of FIG. 6.

The left thrust nozzle 44 and right thrust nozzle 46 are pivotally attached to the swivel housings 40, 42 with flanges 60 matching the bifurcated conduits' flanges 58. As shown in FIGS. 5 through 7, multiple washers 62 made of a low-friction material, and a strip 64 around the perimeter of the flanges, reduce friction between the flanges' contact surfaces inside each swivel housing. An O-ring 66 seated in a groove between the flanges further provides a seal against fluid leaks. The flanges 58, 60 and washers 62 are housed inside both swivel housings 40, 42. The swivel housings 40, 42 each further include a front housing element 68 and a rear housing element 70. The swivel housings provide the ability of both the thrust nozzles as well as the main conduit to pivot about a centerline axis "CA" extending through the swivel housings.

Now referring to FIG. 3, the body unit 12 further includes a port side control arm assembly 72 and a starboard side control arm assembly 74, both of which are attached to thrust nozzles 44 and 46 respectively. A cross arm 76 connects the control arm assemblies 72, 74 at their outer ends. Control arm assemblies 72, 74 each include a cross arm collar 78, which is affixed to an outer control arm 80. The outer control arm 80 is further connected to a mid control arm 82, with an extension spring 84 attached to their inner walls. The mid control arm 82 is connected to an inner control arm 86 with an adjustable telescoping mechanism, and the inner control arm 86 is attached to the front surface of the thrust nozzles 44 and 46. By moving the cross arm 76 in an up-and-down direction, the operator can deflect both control arm assemblies 72, 74 together, which in turn deflect the thrust nozzles 44, 46 together to vary the allocation between lift and propulsion force vectors. The flexible articulation at the extension spring 84 allows the operator to deflect port and starboard thrust nozzles 44, 46 by different amounts, thus generating yaw control moments. Moreover, this flexibility provides independent control of either nozzle through a single common linkage, i.e., the cross arm 76. Roll control is not often required in a wingless flight device, but the operator can affect roll control by shifting weight from side-to-side within the body harness system 18. The static and dynamic friction of the thrust nozzles' swivel mechanism are intended to maintain any set deflection position, in order to allow hands-free hovering and to prevent accidental loss of control should the operator release his grip on the cross arm 76.

Figure 9:
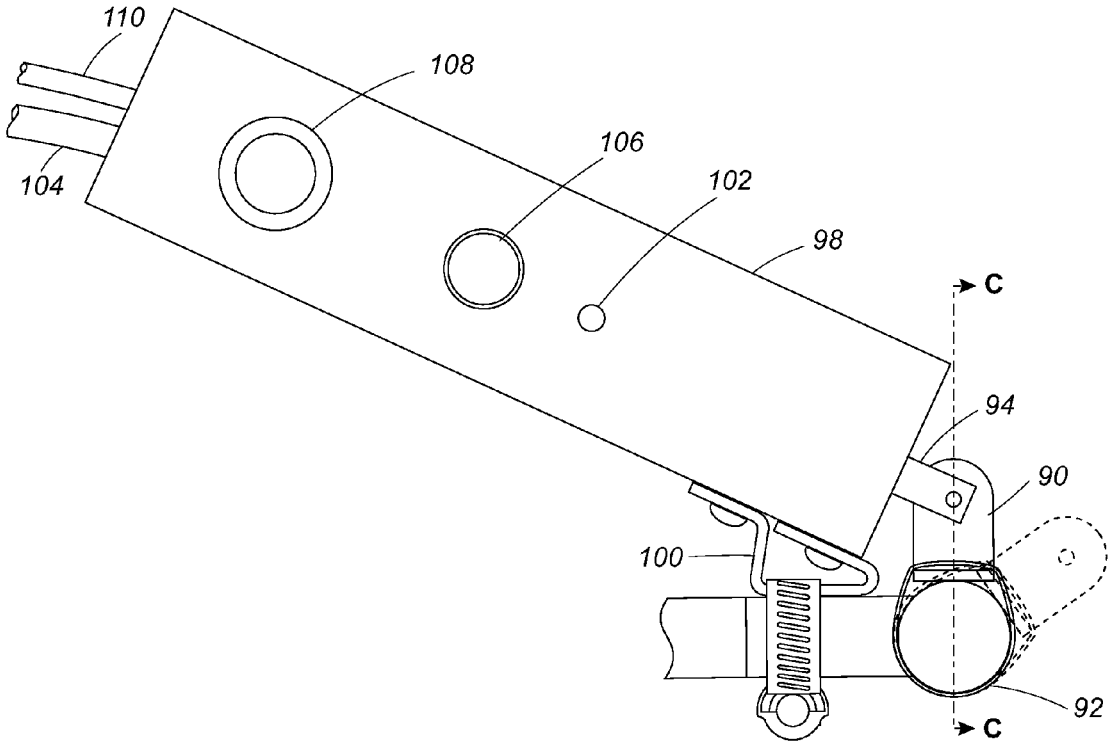
FIG. 9 is a side view of an engine control module in accordance with the present invention.
Figure 10:
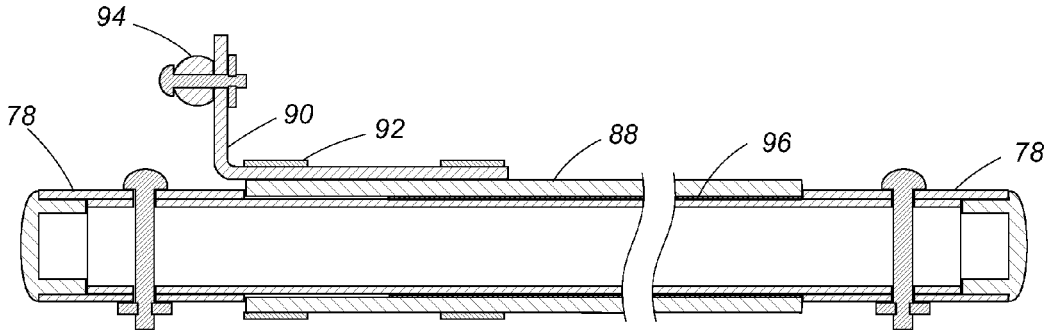
FIG. 10 is a cross sectional view of the cross arm with throttle twist grip at line C-C in FIG. 9.

Now referring to FIGS. 9 and 10, the body unit 12 can include a twist grip control that allows throttle control to be integrated with the cross arm 76. The twist grip control includes a twist grip 88 extends across a substantial length of the cross arm 76, in order to allow the pilot to operate the twist grip control with either one or both hands. A crank 90 is affixed to the end of the twist grip 88 by a clamp 92, and is further pivotally connected to a throttle control master cylinder piston 94. To facilitate free deflection of the twist grip 88, a plastic sleeve 96 can be included to reduce the friction between the twist grip and the inner core of the cross arm 76.

Referring now to FIGS. 3 and 9, a control housing 98 can be affixed to the outer control arm 80 with an angled bracket 100. When the twist grip 88 is rotated by the operator, it deflects the crank 90, which pushes or pulls the throttle control master cylinder piston 94 in a master cylinder (not shown) inside the control housing 98. The master cylinder movements are transmitted by hydraulic pressure along hydraulic tubing 104 to an engine compartment in the base unit 14, where it actuates a dual-action throttle actuator piston to move the throttle crank on an engine. As a result, actuation of the twist grip 88 on the body unit 12 is communicated to the base unit 14, which can result in subsequent modification of the fluid flow provided by the base unit 14. The throttle control mechanism is intended to maintain any set position in order to maintain flight dynamics should the operator release his grip on the cross arm 76. The control housing 98 can also include a start/stop electric control 106 and an engine overheat warning buzzer 108, both of which communicate with the base unit 14 through a multi-lead electric cable 110. Where necessary, additional gauges or monitors for navigation purposes and for monitoring base unit performance may also be located in the control housing 98. The hydraulic tubing 104 and multi-lead electric cable 110 may be integrated with the delivery conduit 16 in order to achieve communication with the base unit 14.

The thrust assembly of the body unit 12 provides lightweight, simple, reliable and stable control for the personal propulsion device 10. When dry, the body unit 12 exerts little weight on the pilot. Moreover, simple mechanical devices provide the pilot with thrust mechanisms as well as pitch, roll and yaw controls. No engine, transmission, or propeller-type devices are located on the body unit 12, the absence of which provides simplicity as well as reliability and safety in the operation of the personal propulsion device 10.

The body unit 12 includes a center of gravity "CG" when in use, where, in an exemplary embodiment of the present invention, the dual thrust nozzles 44 and 46 generate nozzle reaction forces for lift and propulsion at a point well above the center of gravity "CG." By positioning the nozzles above the center of gravity "CG," a significant portion of the forces acting on the body unit, i.e., lift, propulsion, steering, gravity, tension in the delivery conduit, etc., converge normally to the centerline axis "CA" about which the thrust nozzles 44 and 46 and the supply conduit assembly 38 deflect, thereby isolating a substantial amount of the destabilizing forces and moments from the operator. Moreover, as an operator in body unit 12 ascends to greater heights, the weight of fluid moving through the delivery conduit provides greater stability as the weight of the entrained fluid further offsets any destabilizing forces or movements that an operator may experience.

Figure 8:
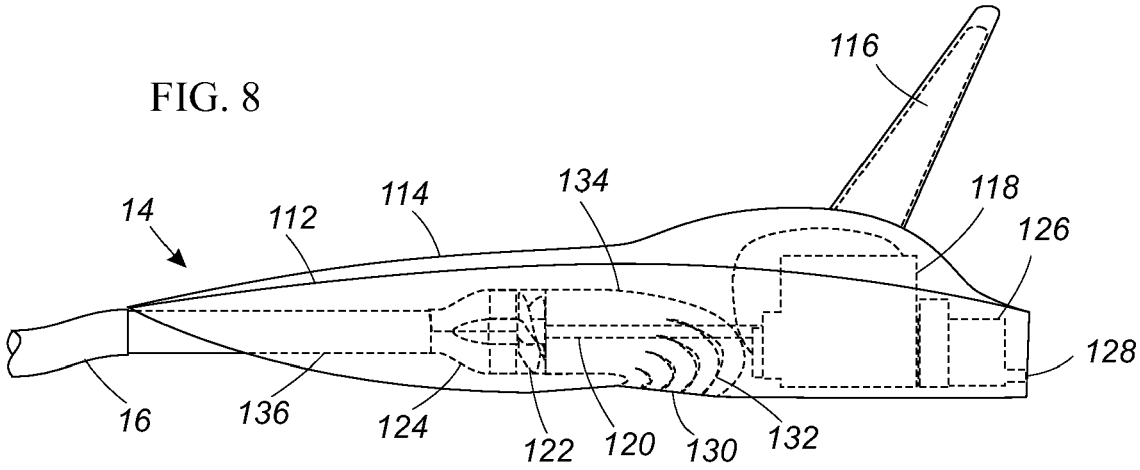
FIG. 8 is a side view of a pump vessel in accordance with the present invention.

In an exemplary embodiment, as shown in FIG. 8, the base unit 14 includes a hull 112, a water-tight deck 114 and a snorkel mast 116 for engine air and ventilation. The engine 118 is located towards the aft portion of the base unit 14, and powers a drive shaft 120 that rotates an impeller 122 in a pump 124. The engine 118 inducts air through an air passage in the snorkel mast 116, and exhaust gases pass through a noise reduction muffler 126 and subsequently exit through an exhaust port 128 located in the stern.

When the engine 118 is in operation, water is inducted through a water intake 130, past stationary guide vanes 132 that divert the water flow forward through a pump intake channel 134 into the pump 124, where the impeller 122 transfers energy to the water to increase its speed and pressure. Pressurized water exits through a bow discharge conduit 136, where the pressurized water flow proceeds into the delivery conduit 16. The delivery conduit 16 provides the pressurized water flow to the main conduit 52 of the body unit 12, where the flow is routed to the left and right thrust nozzles 44 and 46. The engine 118 preferably generates sufficient pressurization of the water exiting the bow discharge conduit 136 such that the fluid mass flow rate at the left and right nozzles of the body unit 12 generate sufficient thrust to lift approximately 200 pounds or more a height of 30 feet for a sustained period of time.

The base unit 14 is intended to be adaptable for a wide variety of applications, and may include variations in form. For example, the base unit 14 may have a wave-piercing hull in order to minimize the possibility of becoming airborne due to large waves. Such activity could interrupt water intake in the base unit 14, resulting in lost thrust in the body unit 12 and the potential for rapid descent of an operator. A wave-piercing hull would ensure that rather than elevating above a large wave, the base unit 14 would pierce or pass through a portion of a wave, thereby remaining in contact with the water and preventing any interruption of fluid flow to the body unit 12.

The delivery conduit 16 is preferably a large diameter hose, i.e., four inches or more, having a lightweight polyester jacket and extruded polyurethane lining. This construction provides sufficient tensile strength for towing the base unit 14, as well as low internal friction, kink resistance, abrasion and chemical resistance, ultraviolet light resistance, high burst strength, and minimal stretching or warping under pressure. In addition to minimizing friction with the pressurized water flow, the delivery conduit also provides additional weight with the entrained water such that flight stability is increased when the personal propulsion device is in operation. Moreover, hydraulic control tubing and control cables may be housed in a flexible protective rubber sheath affixed along a surface of the delivery conduit 16.

By separating the fuselage, engine, pump, electrical system, cooling system, lubrication system, and fuel system of a typical aircraft and instead supporting these systems independently in the base unit 14 on land or water, a very large percentage of the potential weight of the body unit 12 is eliminated. Instead, power is delivered to the body unit 12 through the delivery conduit 16, which carries water from the base unit 14 to the body unit 12. This arrangement allows a relatively small engine to generate sufficient lift and propulsion for the body unit 12, and enables the personal propulsion device 10 to operate with much higher efficiency, more maneuverability, and longer range and flight duration.

Potential applications for the personal propulsion device 10 include a recreational and rescue vehicle, a ship-based mobile vessel system for duties at sea; a land-based fixed system for amusement rides, demonstrations and training; and a stealth mobile vessel system optimized for low-detection underwater travel for law enforcement and military applications.

Figure 11:
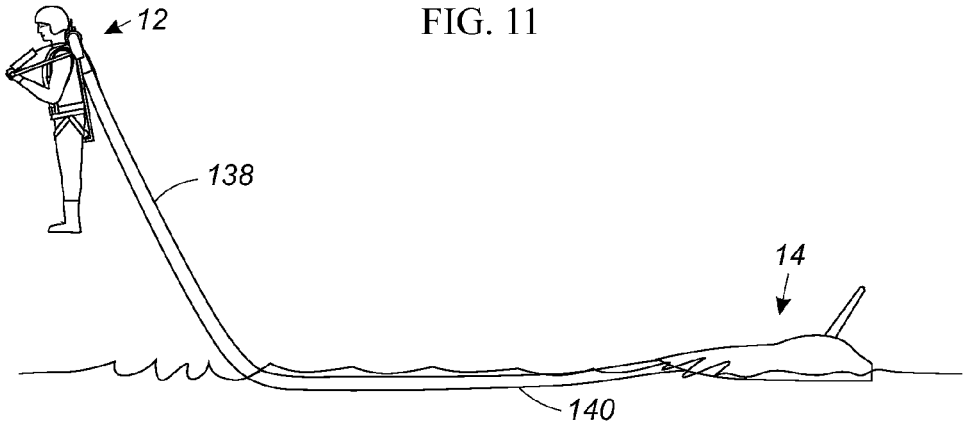
FIG. 11 is an illustration of a personal propulsion device in forward flight in accordance with the present invention.
Figure 12:
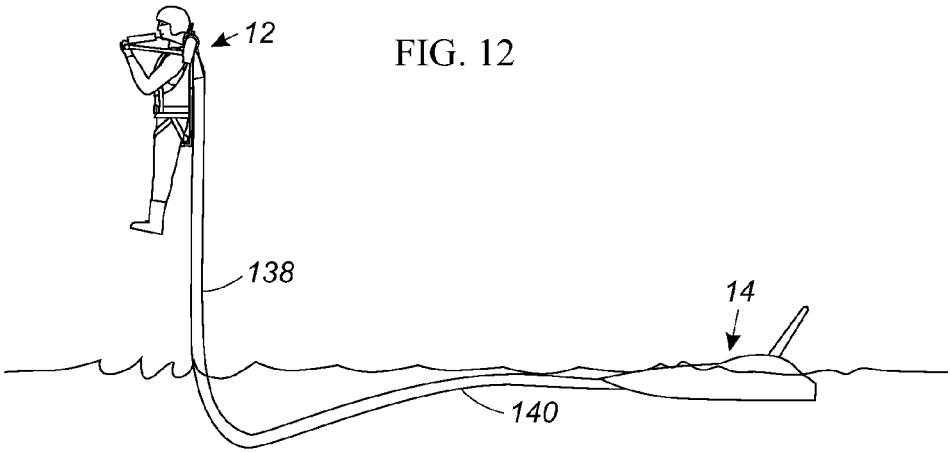
FIG. 12 is an illustration of a personal propulsion device in hover flight in accordance with the present invention.

Referring now to FIGS. 11 and 12, an exemplary embodiment includes using the personal propulsion device 10 over water, wherein the base unit 14 is mobile and is towed along by the thrust generated at the body unit 12. During flight, a section 138 of the delivery conduit 16 is suspended in the air by the lift from the body unit 12. The remaining portion 140 of the delivery conduit 16 between the suspended section and the base unit 14 floats near the surface of the water through natural buoyancy and hydrodynamic lift. In forward flight, the suspended section 138 of the delivery conduit 16 is slanted due to tension between the forward thrust of the body unit 12 and water resistance on the hull 112 of the base unit 14. In hover mode, gravity pulls down on the suspended section 138 of the delivery conduit 16 so that it is almost vertical. The weight of entrained water pulls a section 140 of the hose under water, and provides hover stability to the body unit 12 by offsetting a constant airborne mass against a constant lift from nozzle reaction forces.

Figure 13:
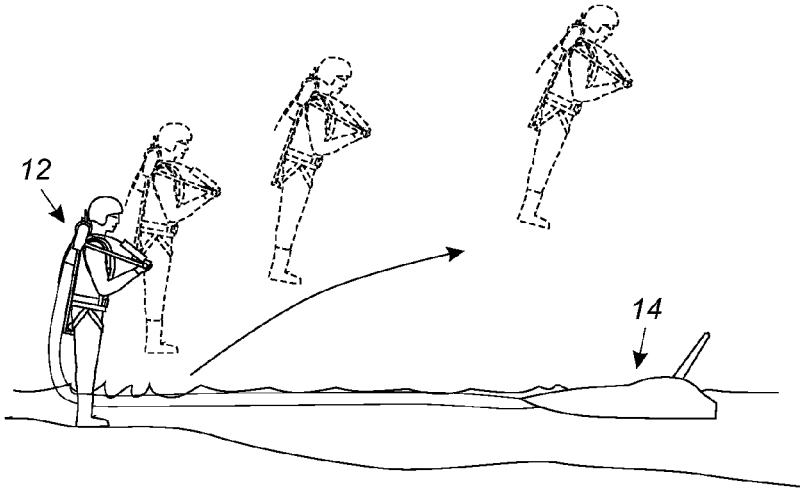
FIG. 13 is an illustration of a takeoff with forward translation of a personal propulsion device from shallow water in accordance with the present invention.

FIG. 13 illustrates a takeoff of the body unit 12 with forward translation. Shallow water may be preferred for performing most takeoffs and landings, although takeoffs from deep water, shores, dock structures or from aboard another vessel are equally possible. Upon deploying the base unit 14 on the water and starting the engine 118, the operator increases the throttle and as lift is felt, he trims the thrust nozzle angles to provide maximum lift and minimal forward propulsion. After takeoff, the pilot continues to increase throttle and at the same time deflect the thrust nozzles rearwards to initiate forward flight. Forward thrust may also be enhanced kinesthetically by pitching the upper torso forward. When in forward flight, the base unit 14 is passively propelled by tension originating from the body unit 12 through the delivery conduit 16 and is slowed down rapidly from water resistance as tension in the delivery conduit 16 is reduced or changes direction. Although not illustrated, alternative embodiments may incorporate active propulsion for the base unit 14 in both forward and reverse directions, in response to flight control commands initiated by the operator on the body unit 12.

Figure 14:
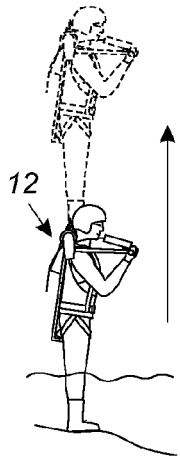
FIG. 14 is an illustration of a vertical takeoff of a personal propulsion device in accordance with the present invention.

Now referring to FIG. 14, in order to hover with the personal propulsion device 10, the operator increases the throttle and at the same time trims the thrust nozzle angles for maximum lift and neutral horizontal propulsion, and continues increasing the throttle until the desired altitude has been reached.

Figure 15:
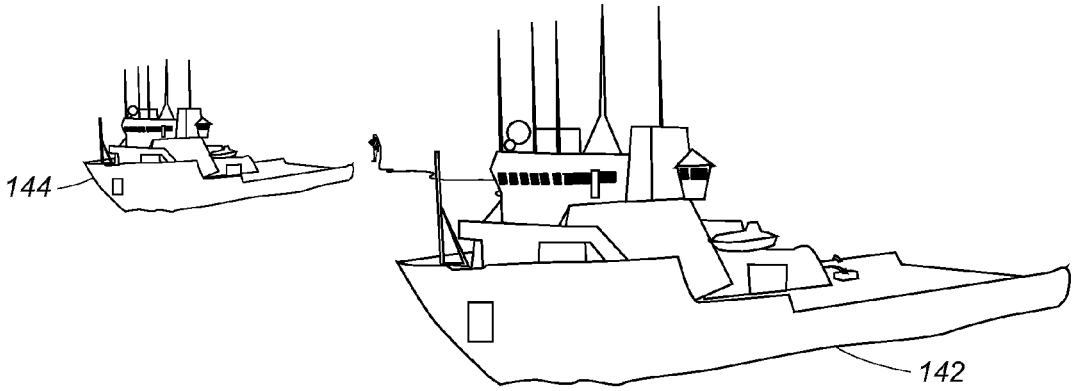
FIG. 15 is an illustration of a method using a personal propulsion device in accordance with the present invention.

As shown in FIG. 15, the personal propulsion device may be used as a ship-based means for transporting personnel or cargo from one ship to another. In such an embodiment, a large multi-purpose pump on a supply or rescue vessel 142 supplies the power for lift and propulsion through the delivery conduit 16, which may have an increased diameter for this particular application, to the body unit 12 as previously described. Repair and maintenance work can be performed on the vessel, and human and cargo payloads can be transferred between the supply ship 142 and another vessel 144, even in relatively rough sea conditions where other methods of transfer may be too dangerous.

Figure 16:
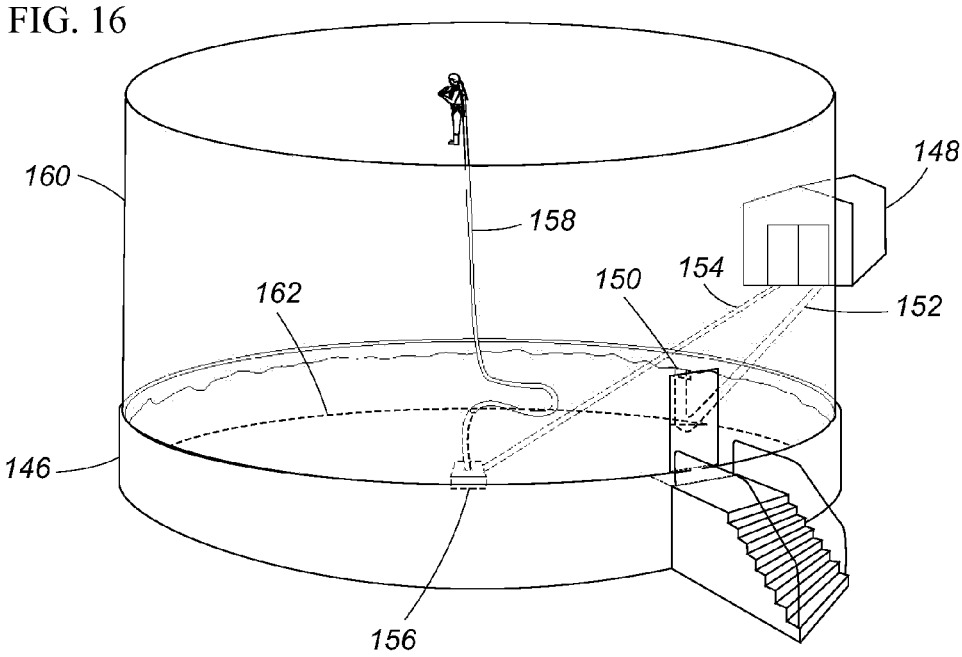
FIG. 16 shows a pond or pool-based embodiment of a personal propulsion device in accordance with the present invention.

Now referring to FIG. 16, an alternative embodiment of use for the personal propulsion device 10 providing a land-based application. In this alternative embodiment, a pond or pool 146 provides a safe and restricted access area for operation. A powerful pump preferably located in a pump house 148 draws in water from near the surface of the pond or pool through a skimmer 150 and a supply duct 152 (shown in this embodiment as buried underground). The water is then pumped through a conduit 154 (also shown in this embodiment as buried underground) to a base 156 at the bottom of the center of the pond or pool 146, then subsequently through a hose 158 to the body unit 12. In this particular embodiment, the water flow at the thrust nozzles may be controlled by a flow regulating device located in a main conduit of the body unit 12. An exterior enclosure 160 may be included to restrict the flight area, and a submerged safety net 162 can provide a safe base for takeoffs and landings. This pond or pool-based embodiment can be installed anywhere with access to a water supply, and hence can be deployed in high traffic amusement parks, next to major traffic arterials, and in gathering areas where a natural body of water is not available. This embodiment is especially useful for marketing, demonstrations, training, pilot certification, and as a paid admission amusement ride.

Figure 17:
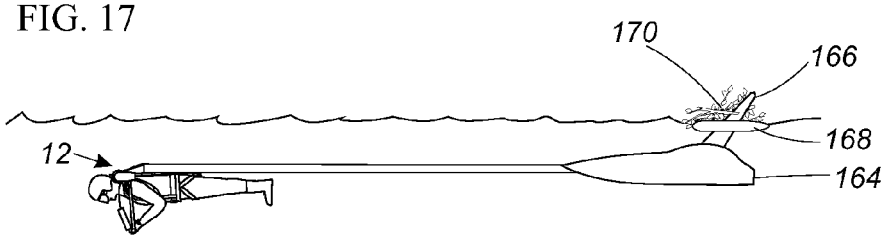
FIG. 17 depicts an alternative use of a personal propulsion device in accordance with the present invention.

In yet another embodiment of the present invention an operator can use the personal propulsion device 10 for travel in both air and water. As shown in FIG. 17, an alternative embodiment of the present invention provides for low-detection travel under water. Assisted by an underwater breathing apparatus or snorkel equipment, the operator can travel underwater for long distances with water jet propulsion from a ballasted base unit 164. A snorkel mast 166 is fitted with ports and passages for engine air intake and exhaust, and a floatation chamber 168 operates to keep the snorkel ports above the waterline when the base unit 164 is under tow. Camouflage material 170 such as an artificial waterfowl or floating debris may be affixed to the snorkel tower 166 to disguise the tower and the wakes generated when traveling. This embodiment may be favorably employed in military and law enforcement applications where both stealth and airborne mobility are important for approaching floating or near shore targets.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A method of operating a personal propulsion device, comprising:

providing a personal propulsion device having a body unit with a thrust assembly; a delivery conduit in fluid communication with the thrust assembly; and a base unit in fluid communication with the delivery conduit;

positioning the base unit in fluid communication with water; and delivering pressurized water to the thrust assembly to elevate the body unit for flight.

2. The method according to claim 1, wherein the base unit delivers water to the body unit through the delivery conduit.

3. The method according to claim 1, wherein during flight the personal propulsion device moves the base unit within the water.

4. The method according to claim 1, wherein the delivery of water to the personal propulsion device is sufficient to lift 200 pounds a height of 30 feet for a sustained period of time.

5. The method according to claim 1, further comprising moving the base unit within the water.

6. The method according to claim 5, wherein the delivery of pressurized water to the thrust assembly enables the body unit to move the base unit.

7. The method according to claim 6, wherein during delivery of pressurized water, the body unit is independently movable about the base unit.

8. The method according to claim 1, wherein the base unit is at least partially submerged in the water.

9. The method according to claim 8, wherein the base unit remains at least partially submerged in the water while the body unit is elevated above the water.

10. The method according to claim 1, further comprising adjusting the delivery of pressurized water to the thrust assembly in order to achieve a desired elevation of the body unit.

11. The method according to claim 1, wherein the thrust assembly includes at least two pivotable thrust nozzles.

12. The method according to claim 11, further comprising manipulating the at least two nozzles to move the body unit in a desired direction.

13. The method according to claim 1, wherein during delivery of pressurized water the body unit is independently movable about the base unit.

14. The method according to claim 1, wherein the body unit defines a wave-piercing hull.

15. A method of operating a personal propulsion device, comprising:

providing a personal propulsion device having a body unit with a thrust assembly; a delivery conduit in fluid communication with the thrust assembly; and a base unit in fluid communication with the delivery conduit;

positioning the base unit in fluid communication with water;

delivering pressurized water to the thrust assembly to elevate the body unit, wherein during delivery of pressurized water, the body unity is independently movable about the base unit; and adjusting the delivery of pressurized water to the thrust assembly in order to achieve a desired flight elevation of the body unit.

* * * * *

US007900867C1

(12) EX PARTE REEXAMINATION CERTIFICATE (32nd)

Ex Parte Reexamination Ordered under 35 U.S.C. 257

United States Patent
Li

(10) Number: US 7,900,867 C1
(45) Certificate Issued: Jun. 8, 2015

(54) PERSONAL PROPULSION DEVICE

(75) Inventor: Raymond Li, St. John's (CA)

(73) Assignee: JLIP, LLC, Dania Beach, FL (US)

Supplemental Examination Request:
No. 96/000,029, Jul. 8, 2013

Reexamination Certificate for:

| | |
|---|---|
| Patent No.: | **7,900,867** |
| Issued: | **Mar. 8, 2011** |
| Appl. No.: | **12/767,216** |
| Filed: | **Apr. 26, 2010** |

Related U.S. Application Data

(60) Division of application No. 11/789,552, filed on Apr. 25, 2007, now Pat. No. 7,735,772, which is a continuation of application No. 11/088,330, filed on Mar. 23, 2005, now Pat. No. 7,258,301.

(60) Provisional application No. 60/556,396, filed on Mar. 26, 2004, provisional application No. 60/581,438, filed on Jun. 22, 2004.

(51) Int. Cl.
*B64C 29/00* (2006.01)
*B64C 39/02* (2006.01)

(52) U.S. Cl.
CPC ..... *B64C 39/026* (2013.01)

(58) Field of Classification Search
None
See application file for complete search history.

(56) References Cited

To view the complete listing of prior art documents cited during the supplemental examination proceeding and the resulting reexamination proceeding for Control Number 96/000,029, please refer to the USPTO's public Patent Application Information Retrieval (PAIR) system under the Display References tab.

*Primary Examiner* — Danton DeMille

(57) ABSTRACT

The present invention provides a personal propulsion device including a body unit having a center of gravity, where the body unit includes a thrust assembly providing a main conduit in fluid communication with at least two thrust nozzles, with the thrust nozzles being located above the center of gravity of the body unit. The thrust nozzles are independently pivotable about a transverse axis located above the center of gravity, and may be independently controlled by a single common linkage. The present invention may further include a base unit having an engine and a pump, which provides pressurized fluid to the body unit through a delivery conduit in fluid communication with both the base unit and the thrust assembly.

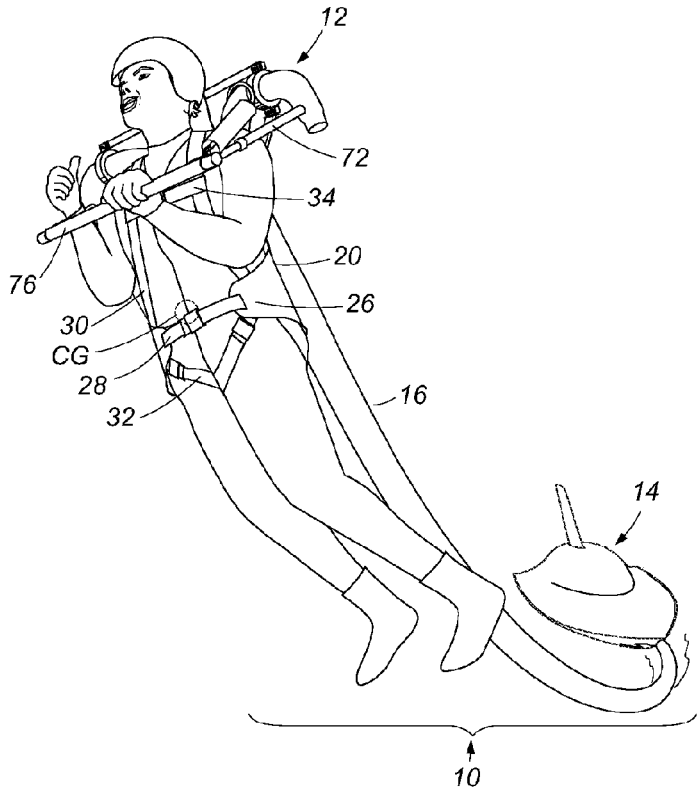

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 5 is cancelled.

Claims 1, 6, 14 and 15 are determined to be patentable as amended.

Claims 2-4 and 7-13, dependent on an amended claim, are determined to be patentable.

New claims 16-108 are added and determined to be patentable.

1. A method of operating a personal propulsion device, comprising:

providing a personal propulsion device having a body unit with a thrust assembly *including a plurality of nozzles configured to generate thrust to directly lift the body unit*; a delivery conduit in fluid communication with the thrust assembly; and a base unit in fluid communication with the delivery conduit;

positioning the base unit in fluid communication with water; [and]

delivering pressurized water to the thrust assembly to elevate the body unit for flight*; and*

*moving the base unit within the water*.

6. The method according to claim [5] *1*, wherein the delivery of pressurized water to the thrust assembly enables the body unit to move the base unit.

14. [The method according to claim 1.] *A method of operating a personal propulsion device, comprising:*

*providing a personal propulsion device having a body unit with a thrust assembly having one or more nozzles configured to generate thrust to directly lift the body unit; a delivery conduit in fluid communication with the thrust assembly; and a base unit in fluid communication with the delivery conduit,* wherein the [body] *base* unit defines a wave-piercing hull;

*positioning the base unit in fluid communication with water; and*

*delivering pressurized water to the thrust assembly to elevate the body unit for flight*.

15. A method of operating a personal propulsion device, comprising:

providing a personal propulsion device having a body unit with a thrust assembly*, the thrust assembly including at least two nozzles configured to discharge a pressurized fluid to directly lift the body unit and an operator*; a delivery conduit in fluid communication with the thrust assembly; and a base unit in fluid communication with the delivery conduit;

positioning the base unit in fluid communication with water;

delivering pressurized water to the thrust assembly to elevate the body unit *and the operator*, wherein during delivery of pressurized water, the body [unity] *unit* is independently movable about the base unit; and adjusting the delivery of pressurized water to the thrust assembly in order to achieve a desired flight elevation of the body unit.

*16. The method according to claim 1, wherein the body unit is configured to attach to a person's torso.*

*17. The method according to claim 1, wherein the body unit includes a navigation gauge or monitor.*

*18. The method according to claim 1, wherein the body unit includes a gauge or monitor configured to monitor base unit performance.*

*19. The method according to claim 1, wherein the thrust assembly includes a main conduit that branches into two conduits.*

*20. The method according to claim 19, wherein the main conduit has an outside diameter of at least four inches.*

*21. The method according to claim 11, wherein the thrust nozzles are independently pivotable with respect to each other.*

*22. The method according to claim 1, wherein the body unit includes a control arm coupled to the thrust assembly, wherein the control arm includes an adjustable telescoping mechanism.*

*23. The method according to claim 1, wherein the plurality of nozzles is configured to maintain any set deflection position.*

*24. The method according to claim 1, wherein the plurality of nozzles is located above a center of gravity of the body unit.*

*25. The method according to claim 1, wherein the plurality of nozzles is located above a combined center of gravity of the body unit, the delivery conduit, and the water moving through the delivery conduit.*

*26. The method according to claim 1, wherein the base unit is a vessel for transporting personnel.*

*27. The method according to claim 1, wherein the base unit is a vessel for transporting cargo.*

*28. The method according to claim 1, wherein the base unit includes a snorkel mast.*

*29. The method according to claim 1, wherein the base unit includes camouflage material.*

*30. The method according to claim 1, further comprising using the body unit to transfer a human from a first vessel to a second vessel.*

*31. The method according to claim 1, further comprising using the body unit to transfer cargo from a first vessel to a second vessel.*

*32. The method according to 1, wherein the body unit includes a throttle operable to adjust the delivery of pressurized water from the base unit to the body unit.*

*33. The method according to claim 1, wherein pressurized water discharged from the thrust assembly generates sufficient thrust to directly lift 200 pounds a height of 30 feet for a sustained period of time.*

*34. The method according to claim 15, wherein the body unit is configured to attach to a person's torso.*

*35. The method according to claim 15, wherein the body unit includes a navigation gauge or monitor.*

*36. The method according to claim 15, wherein the body unit includes a gauge or monitor configured to monitor base unit performance.*

*37. The method according to claim 15, wherein the thrust assembly includes a main conduit that branches into two conduits.*

*38. The method according to claim 15, wherein the at least two nozzles are independently pivotable with respect to each other.*

*39. The method according to claim 15, wherein the body unit includes a control arm coupled to the thrust assembly, wherein the control arm includes an adjustable telescoping mechanism.*

*40. The method according to claim 15, wherein the at least two nozzles are configured to maintain any set deflection position.*

*41. The method according to claim 15, wherein the at least two nozzles are located above a center of gravity of the body unit.*

*42. The method according to claim 15, wherein the at least two nozzles are located above a combined center of gravity of the body unit, the delivery conduit, and the water moving through the delivery conduit.*

*43. The method according to claim 15, wherein the base unit is configured to transport personnel.*

*44. The method according to claim 15, wherein the base unit is configured to transport cargo.*

*45. The method according to 15, wherein the body unit includes a throttle operable to adjust the delivery of pressurized water from the base unit to the body unit.*

*46. A method of operating a personal propulsion device, comprising:*

*providing a personal propulsion device having a body unit with a thrust assembly including at least one nozzle; a delivery conduit in fluid communication with the thrust assembly; and a base unit in fluid communication with the delivery conduit;*

*positioning the base unit in fluid communication with water; and*

*delivering pressurized water to the at least one nozzle such that the at least one nozzle discharges the pressurized water with sufficient thrust to directly lift the body unit and an operator into the air.*

*47. The method according to claim 46, wherein the base unit includes a seat to transport a person.*

*48. The method according to claim 46, further comprising transporting a person on the base unit.*

*49. A method of operating a personal propulsion device, comprising:*

*providing a personal propulsion device having a body unit with a thrust assembly including a plurality of nozzles; a delivery conduit in fluid communication with the thrust assembly; and a base unit in fluid communication with the delivery conduit;*

*positioning the base unit in fluid communication with water;*

*delivering pressurized water to the plurality of nozzles such that the nozzles discharge water to generate sufficient thrust to overcome the weight of the body unit to directly elevate the body unit for flight; and*

*moving the base unit within the water while the body unit is in flight.*

*50. The method according to claim 49, wherein the base unit is configured to transport a person thereon.*

*51. The method according to claim 49, further comprising transporting a person on the base unit.*

*52. A method of operating a personal propulsion device, comprising:*

*connecting a personal propulsion device to a base unit, the personal propulsion device including a body unit with a thrust assembly having a plurality of nozzles configured to directly generate thrust to directly lift the body unit;*

*positioning the base unit in fluid communication with water; and*

*delivering pressurized water from the base unit through a delivery conduit to the thrust assembly to elevate the body unit and an operator supported by the body unit for flight.*

*53. The method according to claim 52, wherein the base unit is configured to transport a person.*

*54. The method according to claim 52, further comprising transporting a person on the base unit.*

*55. A method of operating a personal propulsion device, comprising:*

*connecting a personal propulsion device to a base unit, the personal propulsion device including a body unit with a thrust assembly having a plurality of nozzles configured to discharge a pressurized fluid with sufficient thrust to directly lift the body unit;*

*positioning the base unit in fluid communication with water;*

*delivering pressurized water from the base unit through a delivery conduit to the thrust assembly to elevate the body unit for flight; and*

*moving the base unit within the water.*

*56. The method according to claim 55, wherein the base unit is configured to transport a person thereon.*

*57. The method according to claim 55, further comprising transporting a person on the base unit.*

*58. A method of operating a personal propulsion device, comprising:*

*connecting a personal propulsion device to a base unit with a delivery conduit, the personal propulsion device including a body unit with a thrust assembly having one or more nozzles;*

*positioning the base unit in fluid communication with water; and*

*delivering pressurized water from the base unit through the delivery conduit to the one or more nozzles such that the one or more nozzles discharge water to generate sufficient thrust to overcome a weight of the body unit and an operator supported by the body unit to directly elevate the body unit and operator for flight.*

*59. The method according to claim 58, wherein the base unit is configured to transport a person.*

*60. The method according to claim 58, further comprising transporting a person on the base unit.*

*61. A method of operating a personal propulsion device, comprising:*

*connecting a personal propulsion device to a base unit with a delivery conduit, the personal propulsion device including a body unit with a thrust assembly having a plurality of nozzles;*

*positioning the base unit in fluid communication with water;*

*delivering pressurized water from the base unit through the delivery conduit to the nozzles such that the nozzles discharge water downward to generate thrust sufficient to directly elevate the body unit for flight; and*

*moving the base unit within the water while the body unit is in flight.*

*62. The method according to claim 61, wherein the base unit is configured to transport a person thereon.*

*63. The method according to claim 61, further comprising transporting a person on the base unit.*

*64. A method of operating a personal propulsion device, comprising:*

*providing a personal propulsion device having a body unit with a thrust assembly, the thrust assembly including a nozzle configured to generate thrust to directly lift the body unit; a delivery conduit in fluid communication*

*with the thrust assembly; and a base unit in fluid communication with the delivery conduit;*

*positioning the base unit in fluid communication with water; and*

*delivering pressurized water to the thrust assembly to elevate the body unit and an operator supported by the body unit for flight.*

*65. The method according to claim 64, further comprising transporting a person on the base unit.*

*66. A method of operating a personal propulsion device, comprising:*

*providing a personal propulsion device having a body unit with a thrust assembly having at least one nozzle configured to discharge a pressurized fluid to directly lift the body unit; a delivery conduit in fluid communication with the thrust assembly; and a base unit in fluid communication with the delivery conduit;*

*positioning the base unit in fluid communication with water;*

*delivering pressurized water to the thrust assembly to elevate the body unit for flight; and*

*moving the base unit within the water.*

*67. A method of operating a personal propulsion device, comprising:*

*connecting a personal propulsion device to a base unit with a delivery conduit, the personal propulsion device including a body unit with a thrust assembly having at least one nozzle;*

*positioning the base unit in fluid communication with water; and*

*delivering pressurized water from the base unit through the delivery conduit to the at least one nozzle such that the nozzle discharges water to generate sufficient thrust to overcome a weight of the body unit and an operator supported by the body unit to directly elevate the body unit and operator for flight.*

*68. The method according to claim 67, further comprising transporting a person on the base unit.*

*69. The method according to claim 67, wherein the base unit is a supply vessel.*

*70. The method according to claim 67, wherein the base unit is a rescue vessel.*

*71. A method of operating a personal propulsion device, comprising:*

*connecting a personal propulsion device to a base unit, the personal propulsion device including a body unit with a thrust assembly having one or more nozzles;*

*positioning the base unit in fluid communication with water;*

*delivering pressurized water from the base unit through a delivery conduit to the one or more nozzles such that the one or more nozzles discharge water to directly elevate the body unit and an operator supported by the body unit for flight; and*

*moving the base unit within the water while the body unit and operator are in flight.*

*72. A method of operating a personal propulsion device, comprising:*

*providing a personal propulsion device having a body unit with a thrust assembly including at least two independently controllable thrust nozzles that are independently pivotable; a delivery conduit in fluid communication with the thrust assembly; and a base unit in fluid communication with the delivery conduit;*

*positioning the base unit in fluid communication with water; and*

*delivering pressurized water to the thrust assembly to elevate the body unit for flight.*

*73. The method of claim 72, wherein the at least two independently controllable thrust nozzles are independently pivotable about a common axis.*

*74. The method of claim 72, wherein yaw of the body unit is controlled by deflecting the thrust nozzles.*

*75. The method of claim 72, wherein roll of the body unit is controlled by shifting weight within the body unit.*

*76. The method of claim 72, wherein discharge of pressurized water from the thrust nozzles generates thrust as reactive force vectors for lift and propulsion of the body unit.*

*77. The method of claim 76, wherein allocation of thrust between the reactive force vectors for lift and propulsion is controlled by controlling deflection of the thrust nozzles.*

*78. The method of claim 1, wherein the base unit defines a wave-piercing hull.*

*79. The method of claim 15, wherein the base unit defines a wave-piercing hull.*

*80. The method of claim 46, wherein the base unit defines a wave-piercing hull.*

*81. The method of claim 49, wherein the base unit defines a wave-piercing hull.*

*82. The method of claim 55, wherein the base unit defines a wave-piercing hull.*

*83. The method of claim 61, wherein the base unit defines a wave-piercing hull.*

*84. The method of claim 64, wherein the base unit defines a wave-piercing hull.*

*85. The method of claim 15, further comprising moving the base unit within the water while the body unit is in flight.*

*86. The method of claim 46, further comprising moving the base unit within the water while the body unit is lifted.*

*87. The method of claim 52, further comprising moving the base unit within the water while the body unit is in flight.*

*88. The method of claim 58, further comprising moving the base unit within the water while the body unit is in flight.*

*89. The method of claim 64, further comprising moving the base unit within the water while the body unit is in flight.*

*90. The method of claim 67, further comprising moving the base unit within the water while the body unit is in flight.*

*91. The method of claim 72, further comprising moving the base unit within the water while the body unit is in flight.*

*92. The method of claim 49, further comprising supporting an operator with the body unit, and wherein delivering pressurized water to the plurality of nozzles directly elevates the body unit and operator for flight.*

*93. The method of claim 55, further comprising supporting an operator with the body unit, and wherein delivering pressurized water to the plurality of nozzles directly elevates the body unit and operator for flight.*

*94. The method of claim 61, wherein the plurality of nozzles discharge water downward to generate thrust sufficient to elevate the body unit and an operator supported by the body unit for flight.*

*95. The method of claim 66, wherein delivering pressurized water to the thrust assembly elevates the body unit and an operator.*

*96. The method of claim 71, wherein the one or more nozzles discharge water downward to generate thrust sufficient to elevate the body unit and an operator.*

*97. The method of claim 72, wherein delivering pressurized water to the thrust assembly elevates the body unit and an operator supported by the body unit.*

*98. The method according to 46, wherein the body unit includes a throttle operable to adjust the delivery of pressurized water from the base unit to the body unit.*

*99. The method according to 49, wherein the body unit includes a throttle operable to adjust the delivery of pressurized water from the base unit to the body unit.*

*100. The method according to 52, wherein the body unit includes a throttle operable to adjust the delivery of pressurized water from the base unit to the body unit.*

*101. The method according to 55, wherein the body unit includes a throttle operable to adjust the delivery of pressurized water from the base unit to the body unit.*

*102. The method according to 58, wherein the body unit includes a throttle operable to adjust the delivery of pressurized water from the base unit to the body unit.*

*103. The method according to 61, wherein the body unit includes a throttle operable to adjust the delivery of pressurized water from the base unit to the body unit.*

*104. The method according to 64, wherein the body unit includes a throttle operable to adjust the delivery of pressurized water from the base unit to the body unit.*

*105. The method according to 66, wherein the body unit includes a throttle operable to adjust the delivery of pressurized water from the base unit to the body unit.*

*106. The method according to 67, wherein the body unit includes a throttle operable to adjust the delivery of pressurized water from the base unit to the body unit.*

*107. The method according to 71, wherein the body unit includes a throttle operable to adjust the delivery of pressurized water from the base unit to the body unit.*

*108. The method according to 72, wherein the body unit includes a throttle operable to adjust the delivery of pressurized water from the base unit to the body unit.*

* * * * *